US009286886B2

(12) United States Patent
Minnis et al.

(10) Patent No.: US 9,286,886 B2
(45) Date of Patent: Mar. 15, 2016

(54) METHODS AND APPARATUS FOR PREDICTING PROSODY IN SPEECH SYNTHESIS

(75) Inventors: Stephen Minnis, Norwich (GB); Andrew P. Breen, Norwich (GB)

(73) Assignee: Nuance Communications, Inc., Burlington, MA (US)

( * ) Notice: Subject to any disclaimer, the term of this patent is extended or adjusted under 35 U.S.C. 154(b) by 1065 days.

(21) Appl. No.: 13/012,740

(22) Filed: Jan. 24, 2011

(65) Prior Publication Data

US 2012/0191457 A1 Jul. 26, 2012

(51) Int. Cl.
*G10L 13/08* (2013.01)
*G10L 13/10* (2013.01)

(52) U.S. Cl.
CPC *G10L 13/10* (2013.01); *G10L 13/08* (2013.01)

(58) Field of Classification Search
CPC ..... G10L 13/00; G10L 13/08; G10L 13/10
USPC ..... 704/9, 258, 260–261, 266, 268
See application file for complete search history.

(56) References Cited

U.S. PATENT DOCUMENTS

| | | | | |
|---|---|---|---|---|
| 5,940,797 | A * | 8/1999 | Abe | 704/260 |
| 6,101,470 | A | 8/2000 | Eide et al. | |
| 6,260,016 | B1 * | 7/2001 | Holm et al. | 704/260 |
| 6,845,358 | B2 * | 1/2005 | Kibre et al. | 704/260 |
| 6,990,451 | B2 * | 1/2006 | Case et al. | 704/260 |
| 7,069,216 | B2 * | 6/2006 | DeMoortel et al. | 704/260 |
| 7,136,816 | B1 * | 11/2006 | Strom | G10L 13/10 704/260 |
| 7,155,061 | B2 * | 12/2006 | Lui et al. | 382/186 |
| 7,379,928 | B2 * | 5/2008 | Cukierman et al. | |
| 7,401,020 | B2 | 7/2008 | Eide | |
| 7,865,365 | B2 | 1/2011 | Anglin et al. | |
| 8,321,225 | B1 * | 11/2012 | Jansche et al. | 704/263 |
| 2002/0095289 | A1 * | 7/2002 | Chu et al. | 704/258 |
| 2002/0128841 | A1 * | 9/2002 | Kibre et al. | 704/260 |
| 2003/0028380 | A1 * | 2/2003 | Freeland et al. | 704/260 |
| 2003/0046077 | A1 * | 3/2003 | Bakis et al. | 704/260 |
| 2003/0191645 | A1 * | 10/2003 | Zhou | 704/260 |
| 2004/0260551 | A1 * | 12/2004 | Atkin et al. | 704/260 |
| 2005/0071163 | A1 | 3/2005 | Aaron et al. | |
| 2005/0261905 | A1 * | 11/2005 | Pyo et al. | 704/252 |

(Continued)

OTHER PUBLICATIONS

Wu, Chung-Hsien, et al. "Variable-length unit selection in TTS using structural syntactic cost." Audio, Speech, and Language Processing, IEEE Transactions on 15.4, May 2007, pp. 1227-1235.*

(Continued)

*Primary Examiner* — James Wozniak
(74) *Attorney, Agent, or Firm* — Wolf, Greenfield & Sacks, P.C.

(57) ABSTRACT

Techniques for predicting prosody in speech synthesis may make use of a data set of example text fragments with corresponding aligned spoken audio. To predict prosody for synthesizing an input text, the input text may be compared with the data set of example text fragments to select a best matching sequence of one or more example text fragments, each example text fragment in the sequence being paired with a portion of the input text. The selected example text fragment sequence may be aligned with the input text, e.g., at the word level, such that prosody may be extracted from the audio aligned with the example text fragments, and the extracted prosody may be applied to the synthesis of the input text using the alignment between the input text and the example text fragments.

60 Claims, 4 Drawing Sheets

(56) References Cited

U.S. PATENT DOCUMENTS

| | | | | |
|---|---|---|---|---|
| 2006/0009977 | A1* | 1/2006 | Kato et al. | 704/260 |
| 2006/0095264 | A1* | 5/2006 | Wu et al. | 704/260 |
| 2006/0229877 | A1* | 10/2006 | Tian et al. | 704/267 |
| 2006/0259303 | A1* | 11/2006 | Bakis | 704/268 |
| 2006/0271367 | A1* | 11/2006 | Hirabayashi et al. | 704/261 |
| 2007/0033049 | A1* | 2/2007 | Qin et al. | 704/260 |
| 2007/0055526 | A1* | 3/2007 | Eide et al. | 704/260 |
| 2007/0192105 | A1* | 8/2007 | Neeracher et al. | 704/258 |
| 2008/0109225 | A1* | 5/2008 | Sato | 704/260 |
| 2008/0183473 | A1* | 7/2008 | Nagano et al. | 704/258 |
| 2008/0243508 | A1* | 10/2008 | Masuko et al. | 704/258 |
| 2008/0288257 | A1 | 11/2008 | Eide | |
| 2008/0294443 | A1 | 11/2008 | Eide | |
| 2009/0048843 | A1* | 2/2009 | Nitisaroj G10L | 15/1807 704/260 |
| 2009/0177473 | A1* | 7/2009 | Aaron et al. | 704/260 |
| 2009/0319274 | A1* | 12/2009 | Gross | 704/260 |
| 2011/0112825 | A1* | 5/2011 | Bellegarda | 704/9 |

OTHER PUBLICATIONS

Lindstrom, et al. "Prosody generation in text-to-speech conversion using dependency graphs." Spoken Language, 1996. ICSLP 96. Proceedings., Fourth International Conference on. vol. 3. IEEE, Oct. 1996, pp. 1341-1344.*

Bellegarda, Jerome R. "A dynamic cost weighting framework for unit selection text—to—speech synthesis." Audio, Speech, and Language Processing, IEEE Transactions on 18.6, Aug. 2010, pp. 1455-1463.*

Brierley, Claire, et al. "An approach for detecting prosodic phrase boundaries in spoken English." Crossroads 14.1, Sep. 2007, pp. 1-11.*

Liberman, Mark Y., et al. "Text analysis and word pronunciation in text-to-speech synthesis." Advances in speech signal processing, 1992, pp. 791-831.*

Malfrére, Fabrice, et al. "Automatic prosody generation using suprasegmental unit selection." The Third ESCA/COCOSDA Workshop (ETRW) on Speech Synthesis, Nov. 1998, pp. 1-6.*

Veilleux, Nanette M., et al. "Markov modeling of prosodic phrase structure."Acoustics, Speech, and Signal Processing, 1990. ICASSP-90., 1990 International Conference on. IEEE, Apr. 1990., 777-780.*

Bellegarda, Jerome R., "A dynamic cost weighting framework for unit selection text-to-speech synthesis", *IEEE Transactions on Audio, Speech, and Language Processing* 18 (6): 1455-1463, Aug. 2010.

Needleman, Saul B., and Wunsch, Christian D., (1970), "A general method applicable to the search for similarities in the amino acid sequence of two proteins", *Journal of Molecular Biology* 48 (3): 443-53.

Groves, Declan, "Hybrid Data-Driven Models of Machine Translation", Ph.D. Thesis, Dublin City University School of Computing, Jan. 2007.

* cited by examiner

METHODS AND APPARATUS FOR PREDICTING PROSODY IN SPEECH SYNTHESIS

BACKGROUND OF INVENTION

1. Field of Invention

The techniques described herein are directed generally to the field of speech synthesis, and more particularly to techniques for performing prosody prediction in speech synthesis.

2. Description of the Related Art

Speech synthesis is the process of making machines, such as computers, "talk". Speech synthesizers generally begin with an input text of a sentence or other utterance to be spoken, and convert the input text to an audio representation that can be played, for example, over a loudspeaker to a human listener. Various techniques exist for synthesizing speech from text, including formant synthesis, articulatory synthesis, hidden Markov model (HMM) synthesis, concatenative text-to-speech synthesis and multiform synthesis.

Each of these types of speech synthesis attempts to predict the sequence of sound segments that will best convert the input text to speech. Segments are discrete phonetic or phonological units, such as phonemes, that combine in a distinct temporal order to form a speech utterance encoding some lexical meaning. Often, segments are aspects of speech that are encoded as alphabetic characters when speech is transcribed into writing. For example, for the input text, "See Jack run," a synthesis system would predict the phoneme sequence, /s-ee-j-a-k-r-uh-n/. The synthesis system can then produce each of the sound segments in sequence (e.g., /s/ followed by /ee/, followed by /j/, etc.) to result in an audio utterance of the input text.

SUMMARY OF INVENTION

One embodiment is directed to a method comprising comparing an input text to a data set of text fragments to select a corresponding text fragment for at least a portion of the input text, the corresponding text fragment being associated with spoken audio, wherein the corresponding text fragment does not exactly match the at least a portion of the input text because at least one word is present in one of the matching text fragment and the at least a portion of the input text, but not in both; determining an alignment of the corresponding text fragment with the at least a portion of the input text; and using a computer, synthesizing speech from the at least a portion of the input text, wherein the synthesizing comprises extracting prosody from the spoken audio and applying the extracted prosody using the alignment of the corresponding text fragment with the at least a portion of the input text.

Another embodiment is directed to a system comprising at least one memory storing processor-executable instructions; and at least one processor operatively coupled to the at least one memory, the at least one processor being configured to execute the processor-executable instructions to perform a method comprising comparing an input text to a data set of text fragments to select a corresponding text fragment for at least a portion of the input text, the corresponding text fragment being associated with spoken audio, wherein the corresponding text fragment does not exactly match the at least a portion of the input text because at least one word is present in one of the matching text fragment and the at least a portion of the input text, but not in both; determining an alignment of the corresponding text fragment with the at least a portion of the input text; and synthesizing speech from the at least a portion of the input text, wherein the synthesizing comprises extracting prosody from the spoken audio and applying the extracted prosody using the alignment of the corresponding text fragment with the at least a portion of the input text.

A further embodiment is directed to at least one computer-readable storage medium encoded with a plurality of computer-executable instructions that, when executed, perform a method comprising comparing an input text to a data set of text fragments to select a corresponding text fragment for at least a portion of the input text, the corresponding text fragment being associated with spoken audio, wherein the corresponding text fragment does not exactly match the at least a portion of the input text because at least one word is present in one of the matching text fragment and the at least a portion of the input text, but not in both; determining an alignment of the corresponding text fragment with the at least a portion of the input text; and synthesizing speech from the at least a portion of the input text, wherein the synthesizing comprises extracting prosody from the spoken audio and applying the extracted prosody using the alignment of the corresponding text fragment with the at least a portion of the input text.

BRIEF DESCRIPTION OF DRAWINGS

The accompanying drawings are not intended to be drawn to scale. In the drawings, each identical or nearly identical component that is illustrated in multiple figures is represented by a like numeral. For purposes of clarity, not every component may be labeled in every drawing. In the drawings.

DETAILED DESCRIPTION

Figure 1:
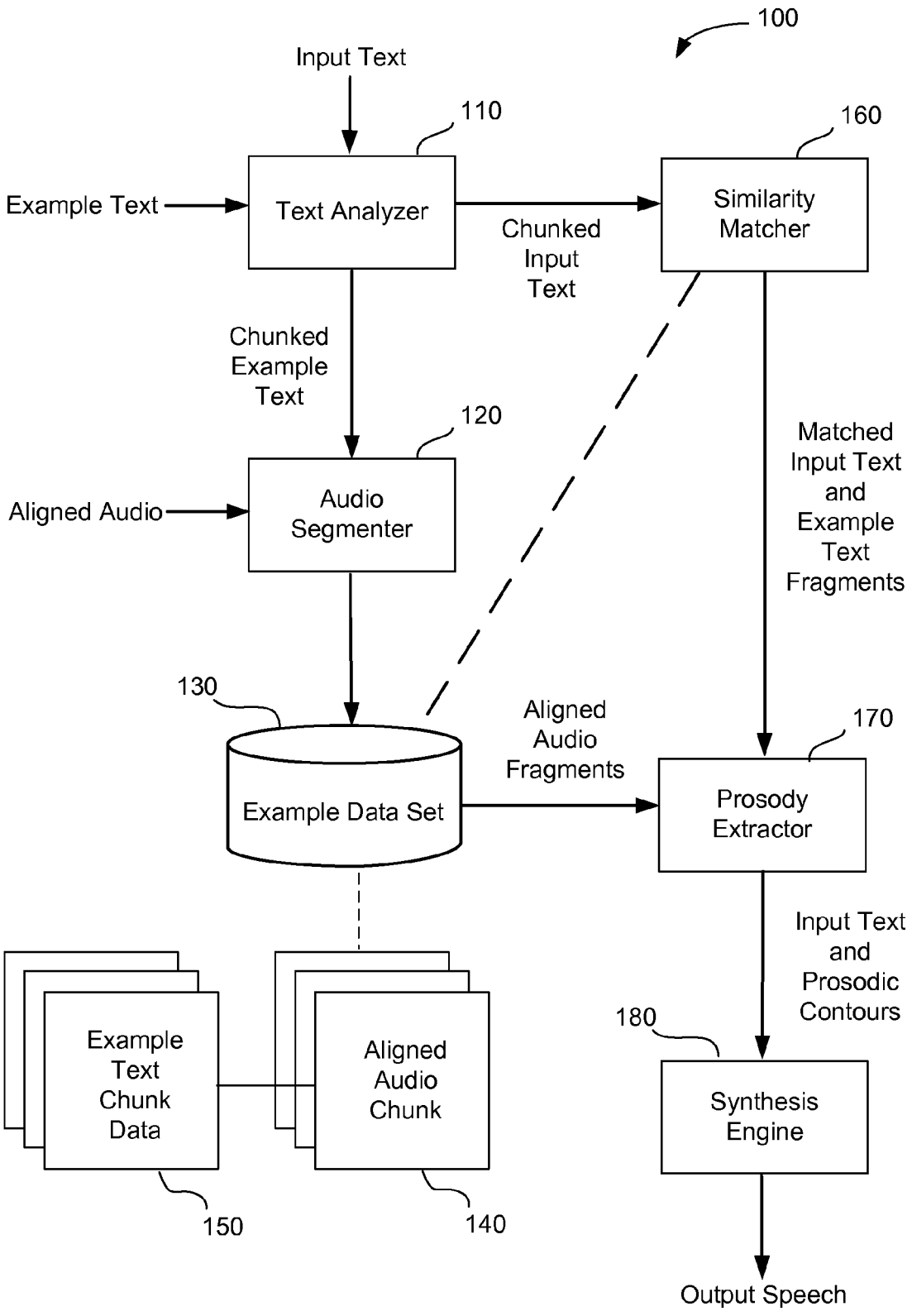
FIG. 1 is a block diagram illustrating an exemplary system for predicting prosody and synthesizing speech in accordance with some embodiments of the present invention.

As techniques for machine synthesis of speech have improved, synthesis systems are increasingly expected not just to predict the phoneme sequence needed to synthesize an input text, but also to predict prosodic characteristics such as rhythm, intonation, emphasis and stress. Prosody refers to certain sound patterns and variations in speech that may affect the meaning of an utterance without changing the words of which that utterance is composed. Prosodic aspects of speech often are missing in written forms, but particularly important prosodic features are sometimes encoded in terms of punctuation and variations in font (italics, bolding, underlining, capitalization, etc.) when speech is transcribed into writing.

For example, consider the differences in meaning between the following sentences, all consisting of the same words: 1) "See Jack run." 2) "See Jack run." 3) "See Jack run." 4) "See, Jack: RUN!" 5) "See Jack . . . run?" All of these sentences would be spoken with the same sequence of sound segments (e.g., phonemes) but with different prosody to convey the different meanings. Prosody can manifest in speech through various acoustic parameters, including pitch (fundamental frequency), loudness (amplitude) and rhythm (durations of words and syllables, as well as pauses between words), among others. For example, sentence #1 would often be spoken with a falling pitch contour (representing a statement), while sentence #5 would often be spoken with a rising pitch contour (representing a question). Pitch, amplitude and duration contours are, in a sense, overlaid upon the sequence of sound segments making up the words of the utterance. Prosodic features are thus "suprasegmental", as they coexist with and extend over one or more sound segments in a speech utterance. For example, sentence #2 would often be spoken with a high peak in pitch coinciding with the segment /a/ to emphasize the word "Jack". The prosodic emphasis feature of increased pitch, probably along with increased amplitude and duration, can be viewed as a target superimposed on the segment /a/ (or perhaps on the entire syllable /j-a-k/) to bring focus to the word "Jack".

The task of predicting prosody in artificial speech synthesis can thus be accomplished by generating continuous contours (often by predicting a few target values for certain syllables or segments, and then connecting the targets in a continuous fashion) for acoustic parameters such as pitch and amplitude, as well as durational values for segments and pauses. The predicted segment sequence and prosodic contours can then be combined in the synthesis to create more natural-sounding output speech. In human speech, every utterance has a prosodic contour, with peaks, slopes and valleys in intonation and rhythm on various words and syllables. Therefore, synthetic speech without any attempt at prosody prediction is generally perceived as monotone and robotic. However, not all attempts at incorporating prosody are beneficial, as the quality of the prosody prediction can have a significant impact on the naturalness, and in some cases the meaning, of the output speech. For example, if sentence #1 above were mistakenly synthesized with the prosody appropriate for sentence #5, the intended meaning of the sentence probably would not be correctly interpreted by a listener.

To address this concern, various techniques have been implemented in an attempt to ensure that prosody is predicted correctly in speech synthesis. Some methods rely on rules programmed into the prosody prediction system by a human designer. Such rule-based methods aim to allow the system to grammatically analyze the input text, determine its sentence structure in the way a linguist would, and then apply a set of rules to the sentence structure to generate prosodic parameters from scratch. Other methods rely on having a human speaker provide an example of how he/she would naturally speak the input text. From a stored audio recording of the human speaking the input text, the system can extract prosodic parameters and apply them to a synthetic speech version, resulting in a different (artificial) voice speaking the input text, but with the same prosody as the human speaker's example.

Applicants have recognized that existing techniques for predicting prosody in artificial speech synthesis suffer from various drawbacks in terms of complexity of implementation and naturalness of the resulting speech output. Rule-based prosody prediction systems require establishing and programming a large number of very complex rules to analyze the syntactic structure of an input text and correctly associate that syntactic structure with prosodic characteristics. The rules that human beings naturally implement to speak an infinite variety of sentences with appropriate prosody are surprisingly complex and poorly understood by linguists, such that machine rule-based prosody predictors, even if able to be programmed by expert linguists, often continue to predict prosody that sounds unnatural for new input texts. Moreover, the prosody rules that may apply to a sentence structure in one context often do not carry over to the production of the same sentence structure in a different context. For example, a sentence spoken by a newscaster often has a very different expected prosodic contour than the same sentence spoken in the reading of an audiobook. To account for these differences, prosody predictors would have to be programmed with different rules for different domains, entailing an unmanageable degree of complexity and implementation cost.

On the other hand, current example-based prosody predictors require a human speaker to make an example audio recording of the entire utterance represented by the input text. (In general, an utterance may be defined as a sequence of speech preceded and followed by silence, produced in a single exhalation, after which a human speaker may pause to take a breath before moving on to the next utterance. An utterance is often the length of an entire sentence or a long phrase.) Given the large (indeed, often infinite) number of sentences that a speech synthesis system may be called upon to produce with appropriate prosody, existing example-based prosody prediction techniques, requiring a database of human audio recordings with an exact match to every sentence that may need to be spoken, quickly become impractical (if not impossible) to implement.

Applicants have recognized and appreciated, however, that human-like prosody prediction by machine can be accomplished without need for knowledge of all the rules necessary to predict prosody for all input texts without reference to audio examples, and also without need for a pre-recorded example exactly matching the input text to be synthesized. Rather, Applicants have recognized that archetypical prosodic patterns may be stored for smaller fragments of speech utterances, and these archetypical prosodic patterns may be strung together to form the prosody for a full utterance, even if that utterance has not been recorded or synthesized before. Thus, a new sentence may be broken down into smaller fragments whose syntactic structures match stored patterns for which appropriate prosodic contours are known. The exact words in a sentence fragment need not have been recorded before for the syntactic structure to match a known pattern, and the breakdown of sentences into smaller structural fragments may limit the number of archetypical patterns that need to be stored and retrieved. Applicants have recognized and appreciated that such processing may be applied to prosody prediction by machine to result in the synthesis of natural-sounding prosody.

Thus, in accordance with some embodiments of the present invention, techniques are provided that can predict prosody for new input texts with reference to a data set of example utterances, without need for an exact match to the input text to be present in the example data set. The example data set may contain example text with spoken audio aligned with the example text, and in some embodiments may include different data sets for different domains. For example, one domain-specific example data set may contain the text of various works of William Shakespeare, along with audio recordings of one or more human speakers reading the text aloud. The spoken audio may be aligned with the text such that words in the spoken audio are lined up with words in the stored text. Another domain-specific example data set could contain books by Raymond Chandler; another could contain recordings and transcripts of news broadcasts, weather reports, etc.; another could contain example utterances for a navigational system; etc. As discussed above, different prosodic patterns may be typical for different domains; thus, in some embodiments, more natural prosody may be predicted for an input text in a particular domain by referencing example utterances from that same domain, rather than by referencing example utterances from a generic data set that is not specific to the domain.

When a new input text is to be synthesized, in some embodiments its prosody may be predicted with reference to the examples in the data set for the domain to which the input text belongs. In some embodiments, both the input text and the example text(s) in the data set may be divided into "chunks", and the chunks may be classified and labeled, in such a way that each chunk class is structurally homogeneous. Such "chunking" may be done in any suitable way, including through rule-based techniques and/or through statistical techniques. Rule-based chunking techniques may involve identifying structural markers in the text, and dividing the text into chunks with boundaries at the structural markers. One example of appropriate structural markers that may be used in rule-based chunking is function words. Function words are those words in a language, such as articles, prepositions, auxiliaries, pronouns, etc., that chiefly express grammatical relationships between words in a sentence rather than semantic content. In most languages, function words are a closed class to which new words cannot normally be made up and added. All words in a language that are not function words are content words, such as nouns, verbs and adjectives. Content words chiefly express semantic meaning, and are an open class to which new words can be added at any time.

Statistical techniques for chunking may involve training a statistical model on a large corpus of text to find common patterns that can be divided out into structurally homogeneous chunks. In some embodiments, such statistical modeling may be accomplished by training on a data set of text in the target language along with translations of that text into another language. By observing which consecutive words in the target language tend to remain together when translated into the other language, the statistical model may identify which grammatical sequences form structurally homogeneous chunks by operating as a unit across languages. The best way of defining chunks may differ in different domains and different applications; thus, with the selection of appropriate training data, statistical chunking techniques may be able to adapt to such differences without need for a human developer to determine and program in different chunking algorithms for different domains.

Once the example text(s) in the data set and the input text have been chunked by any suitable technique, in some embodiments the chunk sequence of the input text may be matched to text chunks in the example data set. In some embodiments, the input text may be matched to a best sequence of text fragments in the example data set, where each text fragment in the sequence is taken from a different example text, and where each text fragment is itself a sequence of one or more text chunks. In some embodiments, the goal of such matching may be to identify, for each portion of the chunk sequence of the input text, a best matching text fragment in the example data set, with preference given to finding a sequence with fewer and longer text fragments. For example, an input text divided into ten chunks might be matched to a sequence of three text fragments from the example data set—a first text fragment matching chunks one to four of the input text, a second text fragment matching chunks five to seven of the input text, and a third text fragment matching chunks eight to ten of the input text. In some embodiments, each chunk in an example text fragment that matches a chunk in the input text may, but need not, include exactly the same words as the chunk in the input text; an input text chunk and an example text chunk may match by having similar grammatical and/or semantic structure, as demonstrated by being classified in the same chunk class. In a rule-based chunking technique, for example, each chunk beginning with a marker (e.g., in some embodiments, a function word) may be classified based on the grammatical class of the marker with which it begins. In a statistical chunking technique, chunk classes may be defined implicitly from training data using a clustering algorithm, for example, as will be described below. In addition to matching chunks by class, further similarity measures directed to other linguistic features may be considered in some embodiments, to find the best available match between chunks of the same class. Examples of such similarity measures useful in some embodiments for refining matches between chunk classes are described below.

In some embodiments, once the input text has been matched to a sequence of example text fragments, prosody may be predicted for the input text by extracting prosodic parameters from the audio recordings aligned with the example text fragments, and applying the extracted prosody in the synthesis of output speech from the input text. In some embodiments, the example text fragments may be aligned to the input text at the word and/or syllable level, such that the extracted prosody from the example text fragments can be properly applied to the input text. For example, peaks and valleys in the prosodic contours in the audio recordings may be aligned with particular words and/or syllables in the example text fragments, and may be applied to particular words and/or syllables in the input text using the word- and/or syllable-level alignment between the input text and the example text fragments.

The aspects of the present invention described herein can be implemented in any of numerous ways, and are not limited to any particular implementation techniques. Thus, while examples of specific implementation techniques are described below, it should be appreciated that the examples are provided merely for purposes of illustration, and that other implementations are possible.

An exemplary system 100 for performing prosody prediction and synthesizing speech in accordance with some embodiments of the present invention is illustrated in FIG. 1. As depicted, system 100 includes a text analyzer 110, an audio segmenter 120, a similarity matcher 160, a prosody extractor 170 and a synthesis engine 180. In some embodiments, each of these components may be implemented as a software module executing on one or more processors of one or more computing devices. Such software modules may be encoded as sets of processor-executable instructions on one or more computer-readable storage media (e.g., tangible, non-transitory computer-readable storage media), and may be loaded into a working memory to be executed by one or more processors to perform the functions described herein. It should be appreciated that text analyzer 110, audio segmenter 120, similarity matcher 160, prosody extractor 170 and synthesis engine 180 may be implemented as separate program modules or may be integrated in any suitable way to form fewer separate program modules than are depicted in FIG. 1, as aspects of the present invention are not limited in this respect. Furthermore, the various components of system 100 may be implemented together on a single computing device or may be distributed between multiple computing devices, as aspects of the present invention are not limited in this respect.

In some embodiments, text analyzer 110 may be configured to receive text of any length and to analyze it to divide it into chunks. The resulting chunked text may be stored (e.g., in memory or in any suitable storage medium/media) as separate chunks, or may be stored as intact text with labels to indicate the boundaries between chunks. It should be appreciated that text and other data may be encoded and stored in any suitable way in connection with system 100, as aspects of the present invention are not limited in this respect. Text analyzer 110 may be configured to chunk text using any suitable technique that results in chunks that are structurally homogeneous. For example, text analyzer 110 may be programmed to use rule-based chunking techniques to identify structural markers in the text and to define chunks based on the markers, as discussed above. The markers may be classified such that text chunks beginning with markers of the same class may be labeled as belonging to the same chunk class. In some embodiments, markers may include function words, and text chunks may be classified based on the grammatical types of the function words with which they begin. In some embodiments, other types of markers may be used in addition to or instead of function words to define chunks; such markers may include punctuation, as well as context markup to denote the beginnings and ends of sentences, paragraphs, lists, documents, etc. Additionally, in some embodiments, some sequences of one or more words in the text may not begin with markers but may yet be separate structurally homogeneous text chunks from the marker chunks; in some embodiments, such non-marker chunks may be designated as "filler" chunks. An exemplary list of chunk classes, as well as the abbreviations with which they are referred to herein, is provided in the following table:

| Marker Type | Chunk Class | Abbreviation |
|---|---|---|
| Function Word | Auxiliary | AUX |
| | Conjunction | CJC |
| | Subordinate Conjunction | CJS |
| | Determiner (e.g., articles) | DET |
| | Interrogative Pronoun (e.g., "wh" - words) | PNI |
| | Preposition | PRP |
| | Pronoun | PRN |
| | Personal Pronoun | PNP |
| Other | Punctuation | PNC |
| | Markup | MKP |
| None | Filler | FIL |

It should be appreciated that the list of marker and chunk classes above is provided by way of example only, and aspects of the present invention are not limited to any particular set of chunk classes or to any particular way of classifying chunks. However, in keeping with the exemplary classifications given above, the following is an example of how a piece of text from the Shakespeare play "Hamlet" could be divided into chunks labeled with the classification scheme above. The exemplary text is, "Well, sit we down, And let us hear Barnardo speak of this."

| [begin sentence] | Well | , | sit | we | down | , |
|---|---|---|---|---|---|---|
| MKP | FIL | PNC | FIL | PNP | PRP | PNC |

| And | let | us | hear Barnardo speak | of | this | . | [end sentence] |
|---|---|---|---|---|---|---|---|
| CJC | FIL | PRN | FIL | PRP | DET | PNC | MKP |

The foregoing example illustrates one way in which text analyzer 110 may go about chunking text, in some embodiments. In this example, text analyzer 110 may parse a text word-by-word from left to right, following the text reading direction of the English language. (It should be appreciated, however, that text analyzer 110 may in some embodiments parse texts from right to left for languages with right-to-left text reading directionality.) While parsing, if the current word (or symbol in the case of punctuation) is a marker of one of the defined grammatical classes, text analyzer 110 may assign that chunk class to that word. In some embodiments, if the following word is of the same marker class as the current word, then text analyzer 110 may assign that word to the same chunk as the current word. Also, if the current word and any of the immediately following words are part of a basic noun phrase or basic verb phrase, then all of the words in the basic noun or verb phrase may be assigned to the same chunk. A basic noun phrase may be defined as a noun plus any immediately preceding adjective(s) and/or determiner. For example, "the red hat" would be a basic noun phrase, and would be classified as a DET chunk in these exemplary embodiments. A verb phrase may be defined as a main verb plus any immediately preceding auxiliaries. For example, the sequences "speak", "is speaking" and "has spoken" would each be basic verb phrases; "speak" would be classified as a FIL chunk, while "is speaking" and "has spoken" would be classified as AUX chunks in these exemplary embodiments. Similarly, in some embodiments, words that are part of a basic adjective or adverb phrase may be assigned together to an undivided chunk. Finally, in some embodiments, any words that are not otherwise assigned as described above may be assigned to "filler" (FIL) chunks by text analyzer 110.

In some embodiments, text analyzer 110 may operate to chunk a large set of example texts to build the data set that will be used as a reference in predicting prosody for future new input texts. In some embodiments, the same text analyzer 110 that chunked the example texts may also be used to chunk the input texts for whose synthesis the prosody is predicted from the example texts. However, aspects of the present invention are not limited to such an arrangement. For example, in some embodiments, example texts may be analyzed and chunked by a different text analyzer than the text analyzer used to chunk the input text. In some embodiments, example texts may be analyzed and example data set 130 may be created by a separate system from prosody prediction system 100. For instance, example data set 130 may be created in advance by a separate system and pre-installed in system 100, and text analyzer 110 in system 100 may only be used to analyze input texts to be synthesized. However, in some embodiments, even if example data set 130 is initially created by a separate system, text analyzer 110 in system 100 may still be used to analyze further example texts to update and add to example data set 130. It should be appreciated that all of the foregoing configurations are described by way of example only, and aspects of the present invention are not limited to any particular development, installation or run-time configuration.

In some embodiments, each example text used to build the example data set may be associated with aligned audio representing the example text as spoken aloud. In some embodiments, spoken audio aligned with example texts may all be produced by human speakers, either by the same human speaker for all example texts, or by different human speakers for different sets of example texts. For example, a set of example texts and corresponding spoken audio may be obtained from audiobook readings of stories written by a particular author. In other embodiments, some or all of the spoken audio aligned with example texts may have been produced artificially (e.g., via machine speech synthesis) with prosody implemented in some appropriate way. Example texts and aligned spoken audio may be procured in any suitable way and/or form, as aspects of the present invention are not limited in this respect. In addition, any suitable alignment technique may be used to align the audio examples with their text transcriptions, as aspects of the present invention are not limited in this respect. In some embodiments, words, syllables, and/or their starting and/or ending points in the example texts may be labeled with timestamps indicating the positions in the corresponding audio recordings at which they occur. Such timestamps may be used, for example, to identify the specific words, syllables and/or sound segments in the text to which particular prosodic events in the corresponding audio recording are aligned. Timestamps may be stored, for example, as metadata associated with the example text and/or with the aligned audio for use by system 100.

In some embodiments, text analyzer 110 may pass the chunked example text to audio segmenter 120, which may also receive the spoken audio aligned with the example text. Audio segmenter 120 may then use the example text as chunked by text analyzer 110 as a reference in dividing the aligned audio into corresponding chunks. This may be done using any suitable audio file manipulation method, examples of which are known. Like the analysis of the example text, the corresponding audio segmentation may be done within prosody prediction system 100 in some embodiments, and may be done by a separate system to create a pre-installed example data set in some embodiments, as aspects of the present invention are not limited in this respect. Once the aligned audio and the example text are both divided into corresponding chunks, both may be stored in association with each other in example data set 130 for use in future prosody prediction. Example data set 130 may be implemented in any suitable form, including as one or more computer-readable storage media (e.g., tangible, non-transitory computer-readable storage media) encoded with data representing example text chunks and corresponding aligned spoken audio chunks.

In some embodiments, each aligned audio chunk 140 may be stored as a separate digital audio file associated (e.g., through metadata) with its corresponding example text chunk data 150. Example text chunk data 150 may include the example text chunk to which the corresponding audio chunk is aligned. In addition, in some embodiments example text chunk data 150 may include the timestamps representing the alignment, data indicating to which full example text the chunk belongs, and/or data indicating its position in the chunk sequence of the full example text. In other embodiments, however, individual chunks of example texts and their corresponding aligned audio may not be stored separately. In some embodiments, example texts and their corresponding aligned audio may be stored as intact digital files, with labels or other suitable metadata to indicate the locations of boundaries between chunks in the text and/or the aligned audio. In such embodiments, the functions of audio segmenter 120 may not be required, as audio files may be processed intact using timestamps (e.g., timestamps received with the example text and aligned audio from a pre-existing data set) to locate relevant portions aligned with text chunks and fragments. It should be appreciated that example texts, aligned spoken audio and the locations of chunks therein may be represented, encoded and stored in any suitable data format, as aspects of the present invention are not limited in this respect. In some embodiments, example texts as represented, manipulated and processed in system 100 may all be a single full sentence in length; however, this is not required. In various embodiments, example texts may have a range of lengths, including partial-sentence and multiple-sentence texts.

In some embodiments, example data set 130 may include example texts and corresponding aligned audio specific to a particular domain. Such a domain may be defined in any suitable way, some non-limiting examples of which include a particular synthesis application, a particular genre or a particular author of written works to be "read" by speech synthesis. In some embodiments, system 100 may include multiple example data sets, each with example texts and corresponding aligned audio specific to a different domain. However, in other embodiments, example data set 130 may include generic text and speech, and may not be specific to any particular domain, as aspects of the present invention are not limited in this respect.

In some embodiments, in addition to dividing texts into chunks, text analyzer 110 may also grammatically and/or semantically analyze texts to label linguistic features for the markers and/or chunks it identifies. As such, data stored in example data set 130 for each example text may include values for one or more linguistic features in addition to chunk locations and classifications. In some embodiments, linguistic features may be identified and analyzed to more finely discriminate among matches between chunks of the same chunk class. For example, a chunk in an input text may be of the same class as two different text chunks in the example data set. However, if the input text chunk has the same value for a linguistic feature as the first example text chunk but a different value for that linguistic feature than the second example text chunk, then the first example text chunk may be a better match for the input text chunk.

Any suitable linguistic features and any number of them (including no linguistic features at all in some embodiments) may be considered, as aspects of the present invention are not limited in this respect. However, an exemplary list of linguistic features that may be considered in some particular embodiments may include an exact word/symbol match feature, a part of speech feature, a named entity feature, a numeric token feature, a semantics feature (applied to nouns, verbs, adjectives, adverbs, etc.), a word/symbol count feature and a syllable structure feature. In some embodiments, these linguistic features may be defined as follows.

In some embodiments, an exact word/symbol match feature may be used to increase the matching score of a text fragment that has a higher number of words/symbols that exactly match the words/symbols in the input text with which they are aligned, in comparison with a text fragment with a lower number of words/symbols that exactly match. In some embodiments, the exact word/symbol match may be expressed as a ratio of words/symbols in a text fragment that appear in both the input text and the example text fragment (disregarding spelling variations and other differences that do not affect the lexical meaning of a word) to words/symbols that appear only in one of the two texts. However, an exact word/symbol match feature is not limited to this particular ratio and may be expressed in any suitable manner.

The part of speech feature may categorize each word of each text chunk based on its grammatical part of speech (e.g., noun, verb, adjective, adverb, etc.).

The named entity feature may categorize proper nouns into groups such as "person" nouns, "location" nouns, "organization" nouns, etc.

The numeric token feature may categorize portions of text expressing numeric data, such as dates, times, currencies, etc.

The semantics feature may categorize content words into groups with similar lexical meanings. One example of a known list of semantic categories that may be used for verbs is the Unified Verb Index developed at the University of Colorado. For instance, one example of a verb semantic category in the Unified Verb Index is say-37.7-1-1. The baseform for the category 37.7-1-1 is "say", and the category also includes other verbs such as "announce", "articulate", "blab", "blurt", "claim", etc., which have similar meanings to "say". Another example verb semantic category is talk-37.5, which includes the verbs "speak" and "talk".

The word/symbol count feature may denote the number of words/symbols in each chunk.

The syllable structure feature may denote the number of syllables in each chunk. In some embodiments, a syllable structure feature may also denote the lexical stress pattern of multi-syllabic words. For example, the word "syllable" might have a syllable structure feature value indicating that main lexical stress is placed on the first of the three syllables in the word.

Following are examples of data that may be stored in some embodiments in example data set 130 for two example texts from Shakespeare plays, the first from "Romeo and Juliet" and the second from "Julius Caesar" ([begin sentence] and [end sentence] markup chunks are omitted for convenience in the tables below). Such data may be stored in any suitable format using any suitable data storage technique, as aspects of the present invention are not limited in this respect. In this example, only verb semantics are used; however, it should be appreciated that semantic features for other parts of speech, such as nouns, adjectives and adverbs, may also be used in some embodiments, and aspects of the present invention are not limited to any particular use of a semantics feature.

| | ExactWord/Symbol | | | | | | | | |
|---|---|---|---|---|---|---|---|---|---|
| | What | , | shall | this speech | be spoke | for | our | excuse | ? |
| Chunk Class | PNI | PNC | AUX | DET | FIL | PRP | PRN | FIL | PNC |
| Part of Speech | PNI | — | AUX | DET, noun | verb, participle | PRP | PRN | noun | — |
| Semantics | — | — | — | — | —, talk-37.5 | — | — | — | — |
| Named Entity | — | — | — | — | —, — | — | — | — | — |
| Word/Symbol Count | 1 | 1 | 1 | 2 | 2 | 1 | 1 | 1 | 1 |
| Syllable Structure | 1 | — | 1 | 1, 1 | 1, 1 | 1 | 1 | 2 | — |

| Exact Word/Symbol | What | said Popilius Lena | ? |
|---|---|---|---|
| Chunk Class | PNI | FIL | PNC |
| Part of Speech | PNI | verb, noun, noun | — |
| Semantics | — | say-37.7-1-1, —, — | — |
| Named Entity | — | —, person, person | — |
| Word/Symbol Count | 1 | 3 | 1 |
| Syllable Structure | 1 | 1, 4, 2 | — |

In some embodiments, text analyzer 110 may receive an input text (e.g., without aligned spoken audio) to be synthesized to artificial speech, and may analyze the input text in the same way described above for analyzing example texts, to identify chunks and to label their linguistic features. For example, suppose example data set 130 contained example text and aligned spoken audio from readings of "Romeo and Juliet" and "Julius Caesar", and now system 100 is being used to machine synthesize a reading of "Hamlet", based on the already stored examples of how Shakespearean text is read with proper prosody. Below is an example of how text analyzer 110 might, in some embodiments, analyze a line from "Hamlet" received as an input text ([begin sentence] and [end sentence] markup chunks again omitted for convenience):

| Exact Word/Symbol | What | , | has | this thing | appear'd again tonight | ? |
|---|---|---|---|---|---|---|
| Chunk Class | PNI | PNC | AUX | DET | FIL | PNC |
| Part of Speech | PNI | — | AUX | DET, noun | verb, adverb, adverb | — |
| Semantics | — | — | — | —, — | appear-48.1.1, —, — | — |
| Word/Symbol Count | 1 | 1 | 1 | 2 | 3 | 1 |
| Syllable Structure | 1 | — | 1 | 1, 1 | 2, 2, 2 | — |

When the input text has been chunked (and optionally analyzed for linguistic to features in some embodiments) in such a fashion, similarity matcher 160 may in some embodiments receive the chunked input text (and any associated linguistic feature data), and access example data set 130 to identify and retrieve a set of stored text fragments that can be combined in sequence to match the full input text. In some embodiments, similarity matcher 160 may evaluate various criteria to result in a sequence of one or more example text fragments that best matches the input text, where each text fragment in the sequence is paired with a portion of the input text. In some embodiments, each selected example text fragment may span one or more text chunks, and each chunk of a selected example text fragment may match a corresponding chunk of the portion of the input text with which that example text fragment is aligned. In some embodiments, an example text chunk may be determined to "match" an input text chunk if it is of the same chunk class as the input text chunk. However, in some embodiments, not all of the chunks need match (e.g., be of the same chunk class) between the input text and the example text fragments, as aspects of the present invention are not limited in this respect. For example, in some embodiments, if a portion of the input text has a chunk class sequence that is not found in example data set 130, an example text fragment with a next-best chunk class sequence according to some similarity measure may be selected. Examples of such similarity measures are described below. In some embodiments, such an example text fragment may be selected even if a match to the input text's chunk class sequence does exist in example data set 130, for example if the selected example text fragment nonetheless scores higher based on the similarity measures as described below.

The examples given above illustrate how similarity matcher 160 may in some embodiments match a sequence of example text fragments to an input text. In one example, similarity matcher 160 may determine that the input text from "Hamlet", "What, has this thing appear'd again tonight?" is best matched by a sequence of two example text fragments, one from the "Romeo and Juliet" example text, "What, shall this speech be spoke for our excuse?" and one from the "Julius Caesar" example text, "What said Popilius Lena?" The beginning portion of the input text, "[begin sentence] What, has this thing", corresponds in this example to a sequence of five chunks, with chunk classes "MKP-PNI-PNC-AUX-DET". This matches the chunk class sequence found in the example text fragment, "[begin sentence] What, shall this speech". Similarly, the ending portion of the input text, "appear'd again tonight? [end sentence]" corresponds in this example to a sequence of three chunks, with chunk classes "FIL-PNC-MKP". This matches the chunk class sequence in the example text fragment, "said Popilius Lena? [end sentence]". Similarity matcher 160 may thus match the input text, "What, has this thing appear'd again tonight?" to the example text fragment sequence, "What, shall this speech"-"said Popilius Lena?"

In some embodiments, similarity matcher 160 may determine a matching example text fragment sequence for the input text based solely on matching the sequence of chunk classes in the input text to sequences of chunk classes in the example text fragments. Thus, in some embodiments, as text chunks may be classified into marker chunks and filler chunks, and marker chunks may be classified based on the types of markers with which they begin, each text chunk may be classified into a chunk class that is either a filler chunk class or a marker chunk class. Matching the sequence of chunk classes in the input text to sequences of chunk classes in the example text fragments may then involve matching the sequence of markers and fillers in the input text to sequences of markers and fillers in the example text fragments. However, in other embodiments, similarity matcher 160 may also consider linguistic features of chunks in the input text and the example texts to refine the matching process and to select between multiple chunk class matches. In some embodiments, similarity matcher 160 may compute a similarity measure (or equivalently, a distance measure) between each candidate example text fragment and the portion of the input text with which it would align, and may select a best sequence of example text fragments that maximizes the total similarity measure (or equivalently, minimizes the total distance measure) of the sequence. In some embodiments, an overall similarity measure may be calculated as a weighted combination of similarities between the various linguistic features analyzed for each text.

For instance, in the example above, the example text fragment, "[begin sentence] What, shall this speech" matches the chunk class sequence of the beginning portion of the input text, "[begin sentence] What, has this thing". Furthermore, this pairing of the example text fragment with the beginning portion of the input text has three exact matching words/symbols plus an exact matching markup chunk, and perfect matches in terms of parts of speech, word/symbol counts and syllable structures. Each of these similarities in linguistic features may tend to increase the similarity measure of this example text fragment with the beginning portion of the input text. However, the example text fragment has two words ("shall" and "speech") that are not exact matches. These differences in linguistic features may tend to decrease the similarity measure of the example text fragment. Similarity matcher 160 may carry out a similar computation for the example text fragment, "said Popilius Lena? [end sentence]" with respect to the, "appear'd again tonight? [end sentence]" portion of the input text. Here, the chunk class sequence and the word/symbol count match, and there is one exact matching symbol, but there are mismatching parts of speech, verb semantics and syllable structures.

The degree to which each individual linguistic feature contributes to the similarity measure may in some embodiments be defined by a system developer in any suitable way by individually weighting each feature in the similarity measure computation. For example, in some embodiments, the contribution of the exact match feature for markup (MKP) chunks may be weighted more heavily than other features. In some embodiments, weights for linguistic features may be assigned dynamically, e.g., by applying a dynamic cost weighting algorithm such as that disclosed in Bellegarda, Jerome R., "A dynamic cost weighting framework for unit selection text-to-speech synthesis", *IEEE Transactions on Audio, Speech, and Language Processing* 18 (6): 1455-1463, August 2010, which is incorporated herein by reference. In other embodiments, however, the various linguistic features may be weighted equally. Some linguistic features may even be omitted in similarity measure computations. It should be appreciated that similarity measures between example text fragments and input texts may be computed in any suitable way, as aspects of the present invention are not limited in this respect.

In some exemplary embodiments, similarity measures may be expressed in terms of a distance cost between each example text fragment and the portion of the input text with which it is matched. For example, an example text fragment that exactly matches (i.e., is composed of the very same word sequence as) the input text portion with which it is matched may have a distance cost of zero. Each individual difference between an example text fragment and the input text portion with which it is matched may then add to its distance cost. In some embodiments, the contribution to the total distance cost of each difference in a linguistic feature between an example text fragment and the input text portion with which it is matched may be computed in terms of a weighted Levenshtein distance, in which insertions, deletions and substitutions at the word level may in some embodiments be weighted differently for some features. For instance, in some embodiments, insertions in verb semantics may be weighted more heavily than in other features, in an attempt to ensure that verbs are matched to verbs of the same semantic class. The Levenshtein distances for all linguistic features may then be summed across the entire example text fragment to compute its total distance cost. For instance, as discussed above, the example text fragment, "[begin sentence] What, shall this speech", differs from the input text portion, "[begin sentence] What, has this thing", in that "shall" and "speech" are different words from "has" and "thing", respectively, and also "speech" and "thing" have different noun semantics (in embodiments in which noun semantics are considered). Thus, there are three feature substitutions between this example text fragment and the input text portion with which it is matched, giving the example text fragment a distance cost of three.

Figure 2:
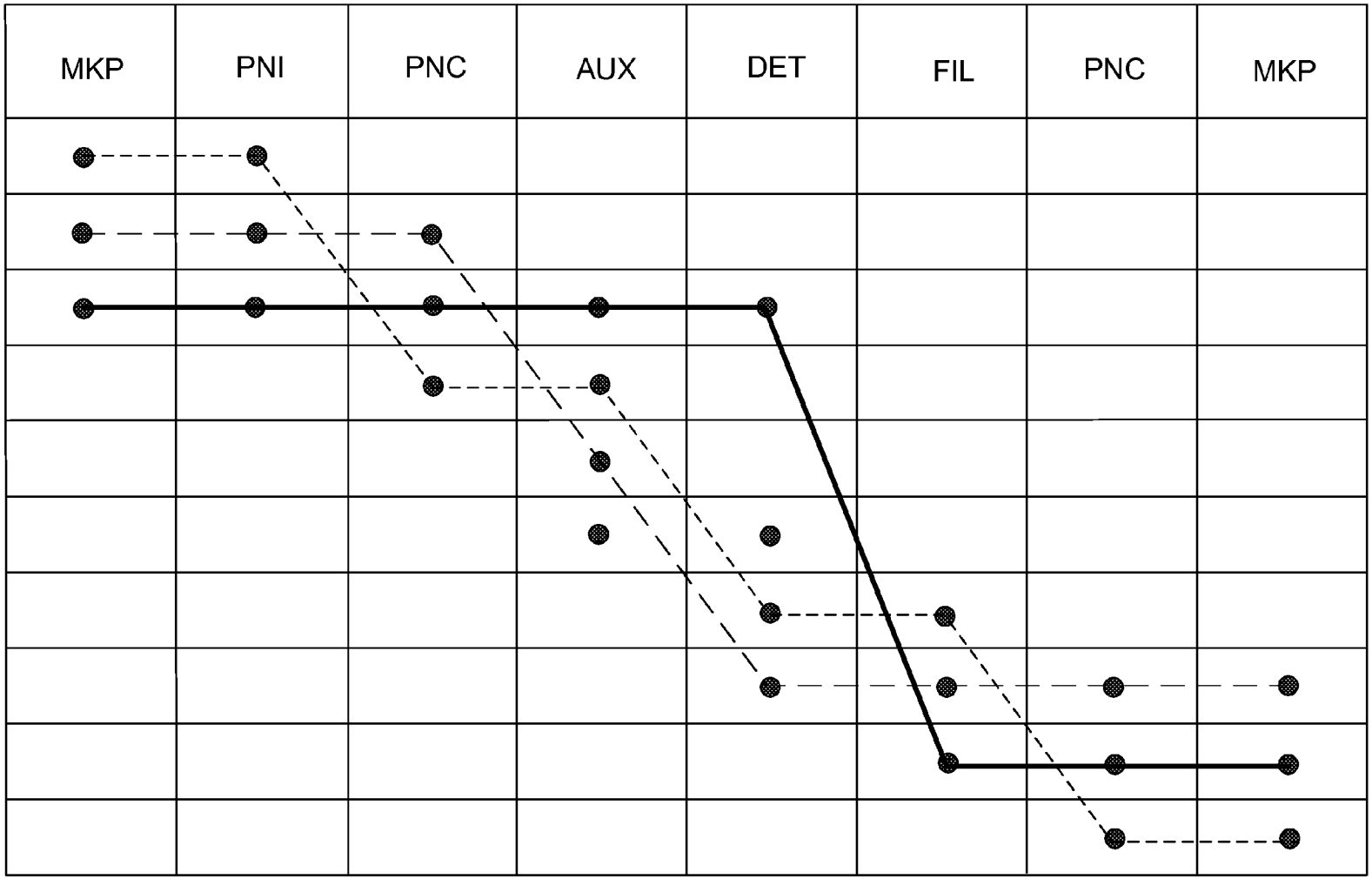
FIG. 2 illustrates an example of matching an input text to a sequence of example text fragments in accordance with some embodiments of the present invention.

In some embodiments, in addition to similarity measures between example text fragments and portions of input text, similarity matcher 160 may also compute join costs to account for a preference for sequences of fewer, longer example text fragments over sequences of more, shorter example text fragments pulled from different example texts. FIG. 2 illustrates how similarity measures and join costs may be used by similarity matcher 160 in some embodiments to select a best sequence of example text fragments for an input text from a set of candidate sequences of example text fragments.

In FIG. 2, the chunk class sequence from the exemplary input text, "What, has this thing appear'd again tonight?" from "Hamlet", is given across the top of the table. Each row of FIG. 2 represents an example text stored in example data set 130 with corresponding aligned spoken audio. In each row, a sequence of dots represents an example text fragment (i.e., all or a portion of an example text spanning one or more text chunks) whose chunk class sequence matches a portion spanning one or more consecutive chunks of the chunk class sequence of the input text. The solid line in FIG. 2 represents the example text fragment sequence selected as best matching the input text in the example described above. As shown, the solid line in FIG. 2 connects two example text fragments in sequence. The first example text fragment is, "What, shall this speech", from "Romeo and Juliet", which matches the first through fifth chunk classes of the input text. The second example text fragment is, "said Popilius Lena?", from "Julius Caesar", which matches the sixth through eighth chunk classes of the input text.

The dashed lines in FIG. 2 represent two other candidate example text fragment sequences considered by similarity matcher 160. In this example, similarity matcher 160 would score each of the three candidate example text fragment sequences in FIG. 2 in terms of combined similarity measures and join costs, to select one of the candidates as the best match to the input text. The line with the smaller dashes in FIG. 2 connects a sequence of four example text fragments, each of the four example text fragments spanning two text chunks that match consecutive chunk classes of the input text. The line with the larger dashes connects a sequence of three example text fragments, one spanning three text chunks (MKP-PNI-PNC), one spanning one text chunk (AUX), and one spanning four text chunks (DET-FIL-PNC-MKP).

In some embodiments, similarity matcher 160 may compute a score, for each candidate sequence, that combines example text fragments to match the chunk class sequence (e.g., the sequence of marker classes, or of marker classes and filler classes) of the input text. In some embodiments, this score may be a combination of a similarity measure for each example text fragment in the candidate sequence and a join cost for each connection between two example text fragments from different example texts (or from different (e.g., non-consecutive) parts of the same example text) in the candidate sequence. In some embodiments, join costs may be computed from relative counts of all the pairwise combinations of chunk classes in sequences in example data set 130. For example, the candidate example text fragment sequence represented by the solid line in FIG. 2 has one connection between example text fragments from different example texts. The last chunk of the first example text fragment in the sequence is of the "DET" class, and it is connected to the first chunk of the second example text fragment, which is of the "FIL" class. To compute a join cost for this connection, similarity matcher 160 may consider, out of all the occurrences of the "DET" chunk class in example data set 130, how many of them are followed by the "FIL" class in the same example text, and may use this count ratio as the join cost for the "DET-FIL" connection. Alternatively, similarity matcher 160 may consider, out of all the occurrences of the "FIL" chunk class in example data set 130, how many of them are preceded by the "DET" class. Another alternative for the join cost may be the ratio of "DET-FIL" sequences to the total number of pairs of chunks in example data set 130. In some embodiments, all joins between different example text fragments may be assigned the same cost, such that each join decreases the score of a candidate example text fragment sequence equally. However, these are merely examples. It should be appreciated that join costs may be computed in any suitable way, as aspects of the present invention are not limited to any particular technique for determining join costs.

Thus, in the example of FIG. 2, a join cost may be computed in any suitable way for the single connection in the candidate sequence represented by the solid line. This join cost may be combined with the similarity measures for each of the two example text fragments in the candidate sequence to compute the total score of the candidate sequence. Thus, in this example, the score for the candidate sequence represented by the smaller dashed line may include three join costs as well as similarity measures for each of four example text fragments, and the score for the candidate sequence represented by the larger dashed line may include two join costs as well as similarity measures for each of three example text fragments. In some embodiments, join costs and similarity measures (or equivalently, distance measures) may be weighted differently in the computation of the total score for a candidate sequence. Weightings of similarity measures may indicate the relative importance of finding the most similar matches to smaller portions of the input text in the example data set, while weightings of join costs may indicate the relative importance of finding longer matches in the data set such that fewer fragments need be used. In some embodiments, such weights may be assigned by a developer of system 100 according to any suitable criteria, as aspects of the present invention are not limited in this respect.

In some embodiments, join costs may be given more weight in the determination of a best sequence of example text fragments for an input text, by ranking and eliminating candidate example text fragment sequences based on join costs in a first pass, and only considering similarity measures afterward in a second pass. For example, in some embodiments, candidate example text fragment sequences (e.g., those sequences of example text fragments from example data set 130 whose sequences of chunk classes match the sequence of chunk classes in the input text) may first be ranked in terms of their total join costs calculated as described above. The top N candidate example text fragment sequences with the lowest total join costs may then be retained, and all other candidate example text fragment sequences with higher total join costs may be eliminated from consideration. The N best sequences in terms of join costs may then be ranked in terms of total similarity measures (or equivalently, total distance costs), and the best matching example text fragment sequence may be selected from this pruned candidate set. Alternatively, in some other embodiments, candidate example text fragment sequences may be pruned based on similarity measures in a first pass, and then a best example text fragment sequence may be selected in a second pass based on join costs.

Exemplary functions of text analyzer 110 and similarity matcher 160 have been described above with reference to examples illustrating a rule-based process for defining text chunks. However, as discussed above, other methods of chunking are possible, and aspects of the present invention are not limited to any particular chunking technique. For example, in some embodiments, instead of explicitly defining how text analyzer 110 will identify text chunks in terms of particular classes of markers, a developer of system 100 may program a statistical model to generate its own data-driven chunk definitions by analyzing a set of training data. As discussed above, in some embodiments, a different statistical model may be built from different training data for each domain of interest, such that the types of chunks identified may be different for different domains.

In some embodiments, a statistical chunking model may create chunk definitions by training on bilingual corpora of text, such as those used for training machine translation models. Such corpora may include text from one language, along with a translation of that text into a different language. By analyzing which consecutive word sequences in the first language also appear as corresponding consecutive word sequences in the translation to the other language, the statistical model may be able to identify text chunks that are linguistically structurally homogeneous. One example of text from such a bilingual corpus is given in Groves, Declan, "Hybrid Data-Driven Models of Machine Translation", Ph.D. Thesis, Dublin City University School of Computing, January 2007, which is incorporated herein by reference. The example (page 38 of the Groves thesis) contains a translation of the English phrase, "could not get an ordered list of services," into French as, "impossible d'extraire une liste ordonnee des services." For this example, a statistical model may identify possible text chunks as follows:

| English text chunk | French text chunk |
|---|---|
| could not | impossible |
| could not get | impossible d'extraire |
| get an | d'extraire une |
| ordered list | liste ordonnée |
| get an ordered list | d'extraire une liste ordonnée |
| could not get an ordered list | impossible d'extraire une liste ordonnée |
| of | des |
| of services | des services |
| ordered list of services | liste ordonnée des services |
| an ordered list of services | une liste ordonnée des services |
| could not get an ordered list of services | impossible d'extraire une liste ordonnée des services |

In the above example, the statistical chunking model may have access to a French-English word dictionary to allow it to align words in the English text to corresponding words in the translated French text. The model may then identify the potential chunks above as text sequences whose words are contiguous in the English version and also contiguous when translated to the French version. The model may also reject certain word sequences as chunk candidates, because their words are contiguous in the English version but do not maintain the same contiguous sequence when translated. For example, in the phrase above, the sequences "not get", "an ordered", and "list of" may not be considered potential chunks because they do not have translations whose words are contiguous in the French version. This may be an indication that "not get", "an ordered", and "list of" may not be structurally homogeneous chunks, because they are not taken together as units in the translation process.

By analyzing a large number of bilingual texts such as the example given above, a statistical chunking model may in some embodiments identify common patterns that tend to behave as structurally homogeneous chunks. In some embodiments, the statistical chunking model may also perform some grammatical analysis to generalize the identified chunks and categorize them into classes. For example, the potential chunk, "of services," may be grammatically analyzed in terms of parts of speech as "article-noun", such that it can be classified together with other "article-noun" potential chunks having different words. The chunk classes and definitions identified by the statistical model may then be used, in some embodiments, in the processing by text analyzer 110 and similarity matcher 160, in a similar fashion to the description above for chunk classes defined by rule. In some embodiments, the statistical chunking model may also identify which linguistic features should be used by text analyzer 110. Alternatively, in some embodiments, a separate statistical model, different from the statistical chunking model, may be trained specifically to identify which linguistic features should be used. These features may be identified based on statistics as to which differences in linguistic features correspond best with differences between chunks in the training data for the statistical model.

In some embodiments, however chunk classes are defined, processing by text analyzer 110 and similarity matcher 160 may result in the input text being matched to a selected sequence of example text fragments from example data set 130. In some embodiments, the input text and the matched sequence of example text fragments, as well as the spoken audio aligned with the example text fragments in example data set 130, may be fed to prosody extractor 170. Prosody extractor 170 may then perform processing to extract prosodic features from the spoken audio aligned with the selected example text fragments, for use by synthesis engine 180 in synthesizing natural-sounding speech from the input text. In some embodiments, more than one matched sequence of example text fragments (e.g., the n-best matches) may be fed to prosody extractor 170, which may then process the multiple matches to determine the best prosodic features for the synthesis of the input text.

In some embodiments, prosody extraction may be performed with reference to an alignment of the sequence of example text fragments with the input text. Such alignment may in some embodiments be performed by similarity matcher 160 and/or prosody extractor 170. In some embodiments, alignment of an example text fragment with a portion of the input text may involve determining a correspondence between words in the example text fragment and words in the input text. For instance, with reference to the example discussed above, the example text fragment "What, shall this speech" may be aligned with the beginning portion of the input text "What, has this thing" by aligning the word "What" with the word "What", the comma with the comma, the word "shall" with the word "has", the word "this" with the word "this", and the word "speech" with the word "thing". Such alignment may be simple when each chunk in the input text corresponds to a chunk in the example text fragment with the same number of words. However, in some instances, a chunk in the input text may have more words than the chunk in the example text fragment with which it is matched, and vice versa. In such instances, in some embodiments, each word in the chunk with fewer words (chunk A) may be aligned through an alignment process with one word in the chunk with more words (chunk B), leaving one or more words in chunk B unaligned, or fit in between other words that are aligned. Alignment of input text with example text fragments may be performed using any suitable technique, as aspects of the present invention are not limited in this respect. Some alignment techniques are known; for example, some embodiments may align portions of the input text with example text fragments by applying the Needleman-Wunsch algorithm (known in the art for aligning protein or nucleotide sequences) to the task of aligning the text. Details of the Needleman-Wunsch algorithm may be found in Needleman, Saul B., and Wunsch, Christian D., (1970), "A general method applicable to the search for similarities in the amino acid sequence of two proteins", *Journal of Molecular Biology* 48 (3): 443-53, which is incorporated herein by reference.

In some embodiments, the alignment of the matched sequence of example text fragments with the input text may be used by prosody extractor 170 to determine which words of the input text should be assigned which prosodic targets extracted from the spoken audio aligned with the example text fragments. For example, suppose the spoken audio aligned with the example text fragment "What, shall this speech" included a pause aligned with the comma and a high pitch target aligned with the word "speech". From the alignment of the example text fragment with the input text, prosody extractor 170 may thus determine that a pause should be aligned with the comma and a high pitch target should be aligned with the word "thing" in the input text portion "What, has this thing". In some embodiments, the alignment of the example text fragments with the input text may include specific alignments at the syllable level, or even at the sound segment level (e.g., using a suitable phonetic transcription method, some of which are known, to transcribe the texts into sequences of sound segments, and using a suitable alignment technique, such as the Needleman-Wunsch algorithm, to align the sound segment sequences with each other), such that prosody extractor 170 may identify specific syllables and/or segments in the input text to be assigned particular prosodic targets.

In some embodiments, prosody extractor 170 may use a statistical model to determine what alterations (if any) to apply to the prosody extracted from the sequence of example text fragments, to fit the input text. Because the input text may not be composed of the same word sequence as the sequence of example text fragments (and indeed, individual portions of the input text may not be composed of the same word sequences as the example text fragments to which they are aligned), the naturalness of the resulting synthesis may in some cases benefit from some alteration to the prosodic contours from the audio aligned with the example text fragments, when the prosodic contours are extracted and applied to the input text. For example, the high pitch target that was observed on the word "speech" in "What, shall this speech be spoke for our excuse?" may be more natural if it is placed at a different pitch (e.g., perhaps not as high, or perhaps even higher) on the word "thing" in the context of the input text, "What, has this thing appear'd again tonight?" In another example, the pause that was observed on the comma in "What, shall this speech be spoke for our excuse?" may be more natural if it is made a different duration (e.g., slightly longer or shorter) on the comma in the context of the input text, "What, has this thing appear'd again tonight?" In some embodiments, such alterations may be generated by a statistical model trained on the data in example data set 130. Given the input of the input text and the matched sequence of example text fragments, or in some embodiments given the prosodic features extracted from the spoken audio aligned with the example text fragments, the statistical prosodic alteration model may be trained to output the most likely prosodic contours for the input text. However, it should be appreciated that aspects of the present invention are not limited to any particular technique for altering extracted prosody to fit the input text. Indeed, in some embodiments, the prosody extracted from the spoken audio aligned with the sequence of example text fragments may not be altered at all, but may be applied unchanged in synthesizing the input text.

In some embodiments, prosody extractor 170 may output a set of one or more prosodic contours to synthesis engine 180, and synthesis engine 180 may apply this set of contours to the input text when synthesizing it to speech. Synthesis engine 180 may use any suitable technique for synthesizing text to speech, as aspects of the present invention are not limited in this respect. Examples of known speech synthesis techniques include formant synthesis, articulatory synthesis, HMM synthesis, concatenative text-to-speech synthesis and multiform synthesis. Regardless of the specific speech synthesis technique used, in some embodiments synthesis engine 180 may apply the prosodic contours generated by prosody extractor 170 to specify prosodic characteristics such as pitch, amplitude and duration of sound segments in the resulting synthesis. In model-based techniques such as formant synthesis, articulatory synthesis and HMM synthesis, specified prosodic characteristics may be directly produced through waveform generation. In techniques such as concatenative text-to-speech synthesis, specified prosodic characteristics may be used to constrain the pre-recorded sound segments that are selected and concatenated to form the synthesized speech. In multiform synthesis, a combination of these techniques may be used.

In some embodiments, prosodic contours may be specified by prosody extractor 170 in terms of a set of prosodic targets (e.g., pitch or fundamental frequency targets, amplitude targets and/or durational values) for particular words, syllables and/or sound segments in the input text. Synthesis engine 180 may then fill in values for words, syllables and/or sound segments in between the given targets, in such a way as to create continuously-varying contours in the specified parameters. In other embodiments, prosody extractor 170 may provide full and continuous contours to synthesis engine 180, and synthesis engine 180 may simply apply the fully specified contours to the speech synthesis. It should be appreciated that prosodic targets and/or contours may be specified by prosody extractor 170 and/or encoded and/or stored in any suitable way in any suitable data format, as aspects of the present invention are not limited in this respect. In some embodiments, synthesis engine 180 may synthesize audio speech from the input text substantially immediately after prosody is predicted by the combined processing of other components of system 100. In other embodiments, however, prosodic contours and/or targets predicted by system 100 may be stored in association with the input text for later synthesis, and may in some embodiments be transmitted along with the input text to a different system for synthesis. It should be appreciated that prosody for an input text, once predicted, may be utilized in any suitable way, as aspects of the present invention are not limited in this respect.

Figure 3:
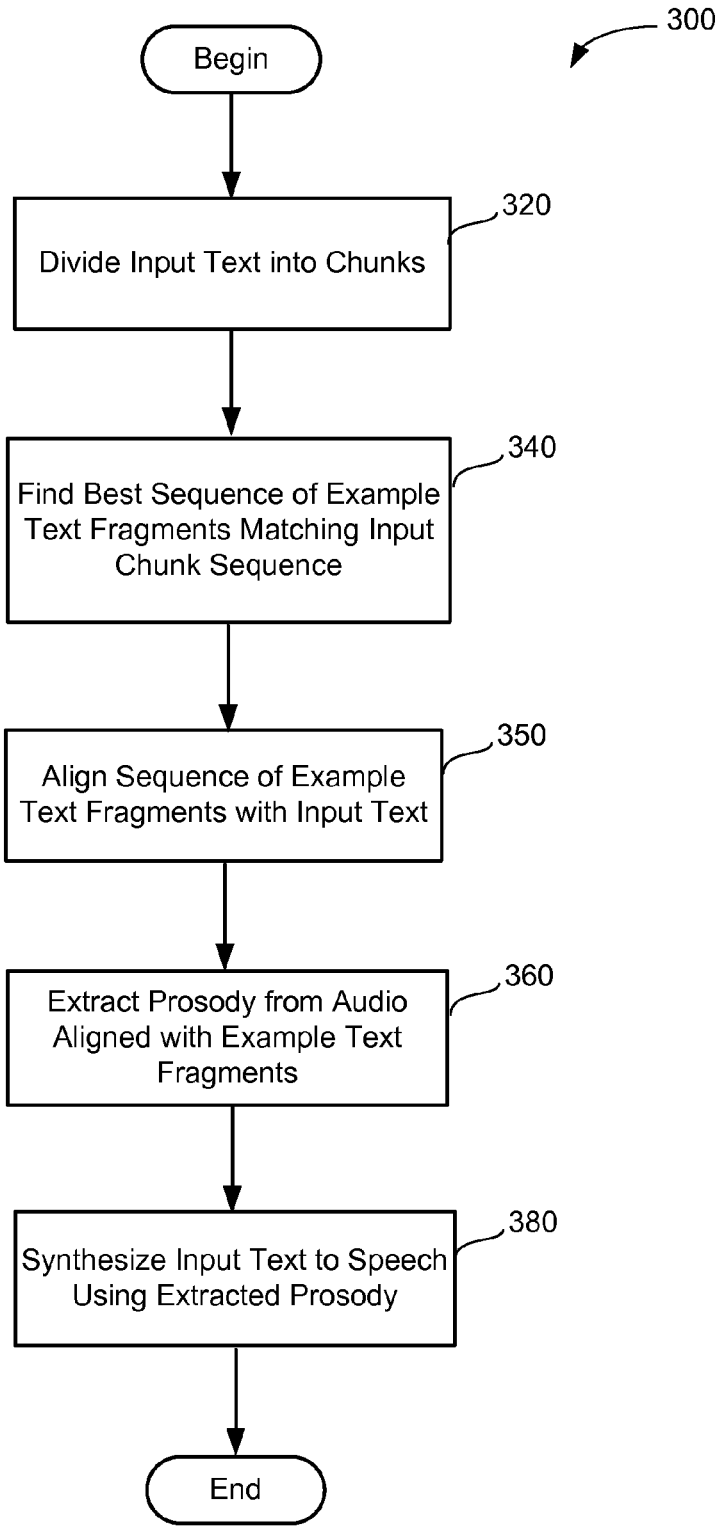
FIG. 3 is a flow chart illustrating an exemplary method for predicting prosody and synthesizing speech in accordance with some embodiments of the present invention.

It should be appreciated from the foregoing that some embodiments of the present invention are directed to a method for predicting prosody for synthesizing speech from an input text, an example of which is illustrated as method 300 in FIG. 3. Method 300 begins at act 320, at which an input text to be synthesized may be analyzed and divided into chunks. As discussed above, any suitable technique may be used to define chunks for dividing up text, as aspects of the present invention are not limited in this respect. Examples of chunking techniques described above include rule-based chunking techniques (e.g., using explicitly defined structural markers such as function words, punctuation and context markup) and statistical chunking techniques.

At act 340, the input text may be compared to a data set of example text fragments to find the best sequence of example text fragments that matches the chunk sequence of the input text. In some embodiments, this comparison may involve selecting a corresponding example text fragment for each portion of the input text, where the corresponding example text fragment has the same chunk class sequence as the portion of the input text to which it is matched. In some cases, a match to an entire input text may be found in one example text fragment. However, in many cases, the corresponding example text fragment that is selected may not exactly match its portion of the input text, as there may be one or more words that are present in either the portion of the input text or in the matching example text fragment, but not in both. Such texts, not consisting of exactly the same word sequences, may still be considered to "match", if they have certain defined characteristics in common. For instance, texts may "match" if they are composed of chunks of the same determined classes, and/or if they have one or more linguistic features in common. At act 350, an alignment may be determined between each example text fragment and the portion of the input text to which it is matched. As discussed above, such alignment in some embodiments may line up words and/or syllables in the example text fragment with words and/or syllables in the input text.

As discussed above, the example text fragments in the data set may in some embodiments be stored along with spoken audio aligned with the text. At act 360, the spoken audio aligned with the selected sequence of example text fragments may be analyzed to extract prosody for use in synthesizing the input text to speech. Such prosody extraction may, in some embodiments, involve specifying one or more prosodic targets and/or contours, such as pitch, amplitude and/or duration targets and/or contours, to be used in the speech synthesis of the input text. At act 380, such speech synthesis may be performed, using the extracted prosody to synthesize the input text in a manner that sounds natural by virtue of having reference to the stored examples of natural prosody in the data set.

Figure 4:
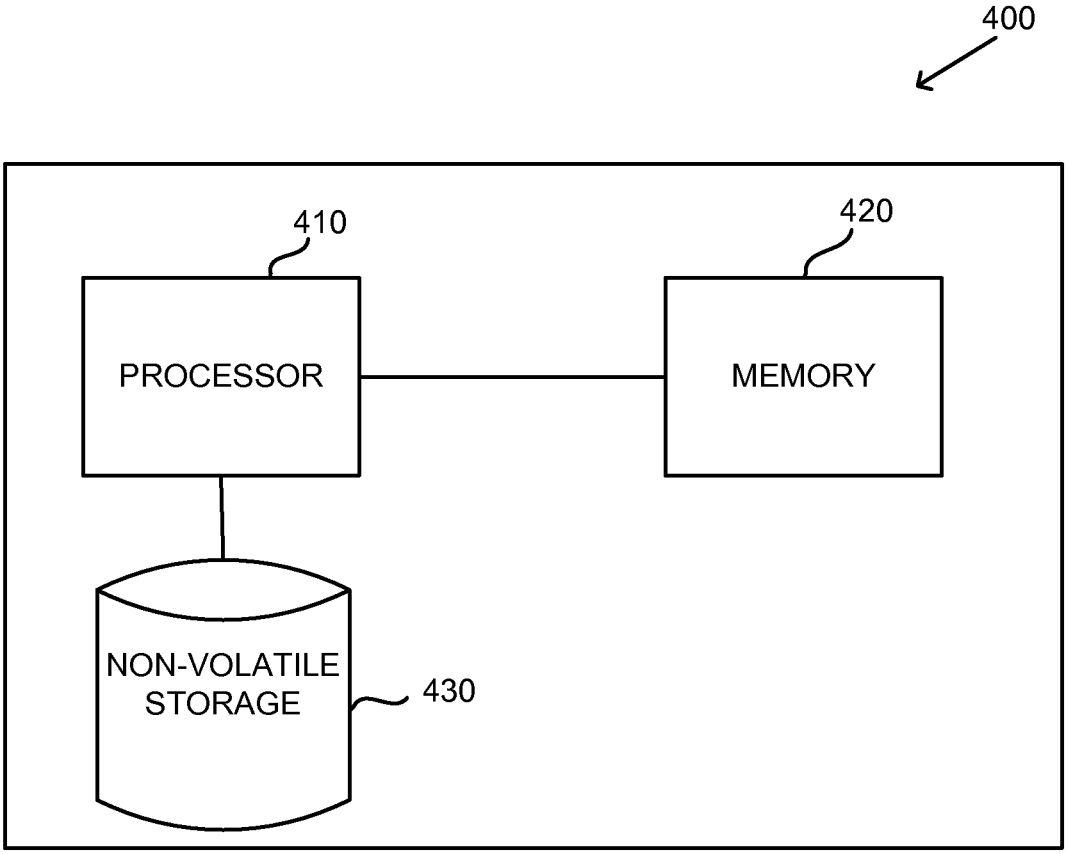
FIG. 4 is a block diagram of an exemplary computer system on which aspects of the present invention may be implemented.

A system for performing prosody prediction in speech synthesis in accordance with the techniques described herein may take any suitable form, as aspects of the present invention are not limited in this respect. An illustrative implementation of a computer system 400 that may be used in connection with some embodiments of the present invention is shown in FIG. 4. One or more computer systems such as computer system 400 may be used to implement any of the functionality described above. The computer system 400 may include one or more processors 410 and one or more tangible, non-transitory computer-readable storage media (e.g., memory 420 and one or more non-volatile storage media 430, which may be formed of any suitable non-volatile data storage media). The processor 410 may control writing data to and reading data from the memory 420 and the non-volatile storage device 430 in any suitable manner, as the aspects of the present invention described herein are not limited in this respect. To perform any of the functionality described herein, the processor 410 may execute one or more instructions stored in one or more computer-readable storage media (e.g., the memory 420), which may serve as tangible, non-transitory computer-readable storage media storing instructions for execution by the processor 410.

The above-described embodiments of the present invention can be implemented in any of numerous ways. For example, the embodiments may be implemented using hardware, software or a combination thereof. When implemented in software, the software code can be executed on any suitable processor or collection of processors, whether provided in a single computer or distributed among multiple computers. It should be appreciated that any component or collection of components that perform the functions described above can be generically considered as one or more controllers that control the above-discussed functions. The one or more controllers can be implemented in numerous ways, such as with dedicated hardware, or with general purpose hardware (e.g., one or more processors) that is programmed using microcode or software to perform the functions recited above.

In this respect, it should be appreciated that one implementation of various embodiments of the present invention comprises at least one tangible, non-transitory computer-readable storage medium (e.g., a computer memory, a floppy disk, a compact disk, and optical disk, a magnetic tape, a flash memory, circuit configurations in Field Programmable Gate Arrays or other semiconductor devices, etc.) encoded with one or more computer programs (i.e., a plurality of instructions) that, when executed on one or more computers or other processors, performs the above-discussed functions of various embodiments of the present invention. The computer-readable storage medium can be transportable such that the program(s) stored thereon can be loaded onto any computer resource to implement various aspects of the present invention discussed herein. In addition, it should be appreciated that the reference to a computer program which, when executed, performs the above-discussed functions, is not limited to an application program running on a host computer. Rather, the term computer program is used herein in a generic sense to reference any type of computer code (e.g., software or microcode) that can be employed to program a processor to implement the above-discussed aspects of the present invention.

Various aspects of the present invention may be used alone, in combination, or in a variety of arrangements not specifically discussed in the embodiments described in the foregoing and are therefore not limited in their application to the details and arrangement of components set forth in the foregoing description or illustrated in the drawings. For example, aspects described in one embodiment may be combined in any manner with aspects described in other embodiments.

Also, embodiments of the invention may be implemented as one or more methods, of which an example has been provided. The acts performed as part of the method(s) may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed. Such terms are used merely as labels to distinguish one claim element having a certain name from another element having a same name (but for use of the ordinal term).

The phraseology and terminology used herein is for the purpose of description and should not be regarded as limiting. The use of "including," "comprising," "having," "containing", "involving", and variations thereof, is meant to encompass the items listed thereafter and additional items.

Having described several embodiments of the invention in detail, various modifications and improvements will readily occur to those skilled in the art. Such modifications and improvements are intended to be within the spirit and scope of the invention. Accordingly, the foregoing description is by way of example only, and is not intended as limiting. The invention is limited only as defined by the following claims and the equivalents thereto.

What is claimed is:

1. A method comprising:

comparing an input text to a data set of text fragments to select a corresponding text fragment for at least a portion of the input text, wherein selecting the corresponding text fragment comprises identifying within the at least a portion of the input text a first sequence of words beginning with a first function word and including one or more words following the first function word, identifying a grammatical type of the first function word beginning the first sequence of words, constraining the identified first sequence of words within the at least a portion of the input text to be matched as a unit to a contiguous sequence of words in a text fragment in the data set, and selecting as the corresponding text fragment a text fragment including as the contiguous sequence of words a second sequence of words beginning with a second function word that is a different word from the first function word but is of the same grammatical type as the first function word, the corresponding text fragment being associated with spoken audio of at least the second sequence of words, wherein the second sequence of words within the corresponding text fragment includes at least one word not present in the first sequence of words within the at least a portion of the input text;

determining an alignment of the corresponding text fragment with the at least a portion of the input text; and using a computer, synthesizing speech from the at least a portion of the input text, wherein the synthesizing comprises extracting prosody from the spoken audio of the second sequence of words, including from the at least one word not present in the first sequence of words, and applying the extracted prosody in synthesizing the speech using the alignment of the corresponding text fragment with the at least a portion of the input text.

2. The method of claim 1, further comprising selecting a second corresponding text fragment for a second portion of the input text, wherein selecting the second corresponding text fragment comprises:

identifying a first marker included in the second portion of the input text;

identifying a class of the first marker; and selecting the second corresponding text fragment based at least in part on the second corresponding text fragment comprising a second marker of the same class as the first marker.

3. The method of claim 2, wherein the class of the first marker is selected from the group consisting of one or more punctuation classes, one or more context markup classes and one or more filler classes.

4. The method of claim 2, wherein determining the alignment comprises aligning the second marker with the first marker.

5. The method of claim 1, wherein identifying the grammatical type of the first function word comprises identifying the first function word as an auxiliary, a conjunction, a subordinate conjunction, a determiner, an interrogative pronoun, a preposition, a pronoun, or a personal pronoun.

6. The method of claim 1, wherein the comparing comprises selecting the corresponding text fragment based at least in part on a similarity measure between one or more linguistic features of the at least a portion of the input text and the corresponding text fragment.

7. The method of claim 6, wherein the similarity measure is determined based at least in part on a ratio of words that appear in both the at least a portion of the input text and the corresponding text fragment.

8. The method of claim 6, wherein the similarity measure is determined based at least in part on a ratio of words having matching parts of speech between the at least a portion of the input text and the corresponding text fragment.

9. The method of claim 6, wherein the one or more linguistic features comprise one or more features selected from the group consisting of a named entity feature, a verb semantics feature, a noun semantics feature, an adjective semantics feature, an adverb semantics feature, and a syllable structure feature.

10. The method of claim 1, wherein the comparing comprises selecting a sequence of corresponding text fragments for the input text.

11. The method of claim 10, wherein the comparing further comprises:

analyzing the input text to identify a sequence of markers in the input text; and selecting the sequence of corresponding text fragments from one or more candidate sequences matching the sequence of markers.

12. The method of claim 11, wherein determining the alignment comprises aligning the sequence of markers in the input text with markers in the sequence of corresponding text fragments.

13. The method of claim 11, wherein the comparing further comprises:

computing a join cost for each of the one or more candidate sequences; and selecting the sequence of corresponding text fragments from the one or more candidate sequences based at least in part on the join cost.

14. The method of claim 10, wherein the comparing further comprises:

inputting the input text to a statistical model to divide the input text into a sequence of input text fragments; and selecting the sequence of corresponding text fragments from one or more candidate sequences matching the sequence of input text fragments.

15. The method of claim 10, wherein at least a first text fragment is adjacent in the sequence of corresponding text fragments to a second text fragment, the first text fragment being associated with first spoken audio and the second text fragment being associated with second spoken audio, wherein the first spoken audio was not spoken consecutively with the second spoken audio.

16. The method of claim 1, wherein the spoken audio is aligned with the corresponding text fragment, and the synthesizing comprises extracting prosody from the spoken audio using the alignment of the spoken audio with the corresponding text fragment.

17. The method of claim 1, wherein the synthesizing comprises extracting at least one prosodic feature from the spoken audio of the at least one word present in the second sequence of the corresponding text fragment and not in the first sequence of the at least a portion of the input text, and incorporating into the synthesized speech the at least one prosodic feature extracted from the at least one word, without incorporating any phonemes of the spoken audio of the at least one word into the synthesized speech.

18. The method of claim 1, wherein the extracting comprises specifying prosody for synthesizing the at least a portion of the input text by inputting the corresponding text fragment to a statistical model trained at least partly on the spoken audio.

19. The method of claim 1, wherein the synthesizing comprises specifying at least one prosodic contour for synthesizing the at least a portion of the input text, wherein the at least one prosodic contour is selected from the group consisting of a fundamental frequency contour, an amplitude contour and a duration contour.

20. The method of claim 1, wherein the data set is specific to a domain to which the input text belongs.

21. A system comprising:

at least one memory storing processor-executable instructions; and at least one processor operatively coupled to the at least one memory, the at least one processor being configured to execute the processor-executable instructions to perform a method comprising:

comparing an input text to a data set of text fragments to select a corresponding text fragment for at least a portion of the input text, wherein selecting the corresponding text fragment comprises identifying within the at least a portion of the input text a first sequence of words beginning with a first function word and including one or more words following the first function word, identifying a grammatical type of the first function word beginning the first sequence of words, constraining the identified first sequence of words within the at least a portion of the input text to be matched as a unit to a contiguous sequence of words in a text fragment in the data set, and selecting as the corresponding text fragment a text fragment including as the contiguous sequence of words a second sequence of words beginning with a second function word that is a different word from the first function word but is of the same grammatical type as the first function word, the corresponding text fragment being associated with spoken audio of at least the second sequence of words, wherein the second sequence of words within the corresponding text fragment includes at least one word not present in the first sequence of words within the at least a portion of the input text;

determining an alignment of the corresponding text fragment with the at least a portion of the input text; and synthesizing speech from the at least a portion of the input text, wherein the synthesizing comprises extracting prosody from the spoken audio of the second sequence of words, including from the at least one word not present in the first sequence of words, and applying the extracted prosody in synthesizing the speech using the alignment of the corresponding text fragment with the at least a portion of the input text.

22. The system of claim 21, wherein the method further comprises selecting a second corresponding text fragment for a second portion of the input text, wherein selecting the second corresponding text fragment comprises:

identifying a first marker included in the second portion of the input text;

identifying a class of the first marker; and selecting the second corresponding text fragment based at least in part on the second corresponding text fragment comprising a second marker of the same class as the first marker.

23. The system of claim 22, wherein the class of the first marker is selected from the group consisting of one or more punctuation classes, one or more context markup classes and one or more filler classes.

24. The system of claim 22, wherein determining the alignment comprises aligning the second marker with the first marker.

25. The system of claim 21, wherein identifying the grammatical type of the first function word comprises identifying the first function word as an auxiliary, a conjunction, a subordinate conjunction, a determiner, an interrogative pronoun, a preposition, a pronoun, or a personal pronoun.

26. The system of claim 21, wherein the comparing comprises selecting the corresponding text fragment based at least in part on a similarity measure between one or more linguistic features of the at least a portion of the input text and the corresponding text fragment.

27. The system of claim 26, wherein the similarity measure is determined based at least in part on a ratio of words that appear in both the at least a portion of the input text and the corresponding text fragment.

28. The system of claim 26, wherein the similarity measure is determined based at least in part on a ratio of words having matching parts of speech between the at least a portion of the input text and the corresponding text fragment.

29. The system of claim 26, wherein the one or more linguistic features comprise one or more features selected from the group consisting of a named entity feature, a verb semantics feature, a noun semantics feature, an adjective semantics feature, an adverb semantics feature, and a syllable structure feature.

30. The system of claim 21, wherein the comparing comprises selecting a sequence of corresponding text fragments for the input text.

31. The system of claim 30, wherein the comparing further comprises:

analyzing the input text to identify a sequence of markers in the input text; and selecting the sequence of corresponding text fragments from one or more candidate sequences matching the sequence of markers.

32. The system of claim 31, wherein determining the alignment comprises aligning the sequence of markers in the input text with markers in the sequence of corresponding text fragments.

33. The system of claim 31, wherein the comparing further comprises:

computing a join cost for each of the one or more candidate sequences; and selecting the sequence of corresponding text fragments from the one or more candidate sequences based at least in part on the join cost.

34. The system of claim 30, wherein the comparing further comprises:

inputting the input text to a statistical model to divide the input text into a sequence of input text fragments; and selecting the sequence of corresponding text fragments from one or more candidate sequences matching the sequence of input text fragments.

35. The system of claim 30, wherein at least a first text fragment is adjacent in the sequence of corresponding text fragments to a second text fragment, the first text fragment being associated with first spoken audio and the second text fragment being associated with second spoken audio, wherein the first spoken audio was not spoken consecutively with the second spoken audio.

36. The system of claim 21, wherein the spoken audio is aligned with the corresponding text fragment, and the synthesizing comprises extracting prosody from the spoken audio using the alignment of the spoken audio with the corresponding text fragment.

37. The system of claim 21, wherein the synthesizing comprises extracting at least one prosodic feature from the spoken audio of the at least one word present in the second sequence of the corresponding text fragment and not in the first sequence of the at least a portion of the input text, and incorporating into the synthesized speech the at least one prosodic feature extracted from the at least one word, without incorporating any phonemes of the spoken audio of the at least one word into the synthesized speech.

38. The system of claim 21, wherein the extracting comprises specifying prosody for synthesizing the at least a portion of the input text by inputting the corresponding text fragment to a statistical model trained at least partly on the spoken audio.

39. The system of claim 21, wherein the synthesizing comprises specifying at least one prosodic contour for synthesizing the at least a portion of the input text, wherein the at least one prosodic contour is selected from the group consisting of a fundamental frequency contour, an amplitude contour and a duration contour.

40. The system of claim 21, wherein the data set is specific to a domain to which the input text belongs.

41. At least one non-transitory computer-readable storage medium encoded with a plurality of computer-executable instructions that, when executed, perform a method comprising:

comparing an input text to a data set of text fragments to select a corresponding text fragment for at least a portion of the input text, wherein selecting the corresponding text fragment comprises identifying within the at least a portion of the input text a first sequence of words beginning with a first function word and including one or more words following the first function word, identifying a grammatical type of the first function word beginning the first sequence of words, constraining the identified first sequence of words within the at least a portion of the input text to be matched as a unit to a contiguous sequence of words in a text fragment in the data set, and selecting as the corresponding text fragment a text fragment including as the contiguous sequence of words a second sequence of words beginning with a second function word that is a different word from the first function word but is of the same grammatical type as the first function word, the corresponding text fragment being associated with spoken audio of at least the second sequence of words, wherein the second sequence of words within the corresponding text fragment includes at least one word not present in the first sequence of words within the at least a portion of the input text;

determining an alignment of the corresponding text fragment with the at least a portion of the input text; and synthesizing speech from the at least a portion of the input text, wherein the synthesizing comprises extracting prosody from the spoken audio of the second sequence of words, including from the at least one word not present in the first sequence of words, and applying the extracted prosody in synthesizing the speech using the alignment of the corresponding text fragment with the at least a portion of the input text.

42. The at least one computer-readable storage medium of claim 41, wherein the method further comprises selecting a second corresponding text fragment for a second portion of the input text, wherein selecting the second corresponding text fragment comprises:

identifying a first marker included in the second portion of the input text;

identifying a class of the first marker; and selecting the second corresponding text fragment based at least in part on the second corresponding text fragment comprising a second marker of the same class as the first marker.

43. The at least one computer-readable storage medium of claim 42, wherein the class of the first marker is selected from the group consisting of one or more punctuation classes, one or more context markup classes and one or more filler classes.

44. The at least one computer-readable storage medium of claim 42, wherein determining the alignment comprises aligning the second marker with the first marker.

45. The at least one computer-readable storage medium of claim 41, wherein identifying the grammatical type of the first function word comprises identifying the first function word as an auxiliary, a conjunction, a subordinate conjunction, a determiner, an interrogative pronoun, a preposition, a pronoun, or a personal pronoun.

46. The at least one computer-readable storage medium of claim 41, wherein the comparing comprises selecting the corresponding text fragment based at least in part on a similarity measure between one or more linguistic features of the at least a portion of the input text and the corresponding text fragment.

47. The at least one computer-readable storage medium of claim 46, wherein the similarity measure is determined based at least in part on a ratio of words that appear in both the at least a portion of the input text and the corresponding text fragment.

48. The at least one computer-readable storage medium of claim 46, wherein the similarity measure is determined based at least in part on a ratio of words having matching parts of speech between the at least a portion of the input text and the corresponding text fragment.

49. The at least one computer-readable storage medium of claim 46, wherein the one or more linguistic features comprise one or more features selected from the group consisting of a named entity feature, a verb semantics feature, a noun semantics feature, an adjective semantics feature, an adverb semantics feature, and a syllable structure feature.

50. The at least one computer-readable storage medium of claim 41, wherein the comparing comprises selecting a sequence of corresponding text fragments for the input text.

51. The at least one computer-readable storage medium of claim 50, wherein the comparing further comprises:

analyzing the input text to identify a sequence of markers in the input text; and selecting the sequence of corresponding text fragments from one or more candidate sequences matching the sequence of markers.

52. The at least one computer-readable storage medium of claim 51, wherein determining the alignment comprises aligning the sequence of markers in the input text with markers in the sequence of corresponding text fragments.

53. The at least one computer-readable storage medium of claim 51, wherein the comparing further comprises:

computing a join cost for each of the one or more candidate sequences; and selecting the sequence of corresponding text fragments from the one or more candidate sequences based at least in part on the join cost.

54. The at least one computer-readable storage medium of claim 50, wherein the comparing further comprises:

inputting the input text to a statistical model to divide the input text into a sequence of input text fragments; and selecting the sequence of corresponding text fragments from one or more candidate sequences matching the sequence of input text fragments.

55. The at least one computer-readable storage medium of claim 50, wherein at least a first text fragment is adjacent in the sequence of corresponding text fragments to a second text fragment, the first text fragment being associated with first spoken audio and the second text fragment being associated with second spoken audio, wherein the first spoken audio was not spoken consecutively with the second spoken audio.

56. The at least one computer-readable storage medium of claim 41, wherein the spoken audio is aligned with the corresponding text fragment, and the synthesizing comprises extracting prosody from the spoken audio using the alignment of the spoken audio with the corresponding text fragment.

57. The at least one computer-readable storage medium of claim 41, wherein the synthesizing comprises extracting at least one prosodic feature from the spoken audio of the at least one word present in the second sequence of the corresponding text fragment and not in the first sequence of the at least a portion of the input text, and incorporating into the synthesized speech the at least one prosodic feature extracted from the at least one word, without incorporating any phonemes of the spoken audio of the at least one word into the synthesized speech.

58. The at least one computer-readable storage medium of claim 41, wherein the extracting comprises specifying prosody for synthesizing the at least a portion of the input text by inputting the corresponding text fragment to a statistical model trained at least partly on the spoken audio.

59. The at least one computer-readable storage medium of claim 41, wherein the synthesizing comprises specifying at least one prosodic contour for synthesizing the at least a portion of the input text, wherein the at least one prosodic contour is selected from the group consisting of a fundamental frequency contour, an amplitude contour and a duration contour.

60. The at least one computer-readable storage medium of claim 41, wherein the data set is specific to a domain to which the input text belongs.

* * * * *